US008807406B1

(12) United States Patent
Thach

(10) Patent No.: US 8,807,406 B1
(45) Date of Patent: Aug. 19, 2014

(54) MULTI-PURPOSE CONVERTIBLE CARRIER

(76) Inventor: Chris H. Thach, Thorton, CO (US)

( * ) Notice: Subject to any disclaimer, the term of this patent is extended or adjusted under 35 U.S.C. 154(b) by 401 days.

(21) Appl. No.: 13/351,255

(22) Filed: Jan. 17, 2012

(51) Int. Cl.
*A45F 3/14* (2006.01)
*A45F 4/02* (2006.01)
*A45F 5/00* (2006.01)

(52) U.S. Cl.
USPC ..... 224/275; 224/257; 224/258; 224/153; 224/270

(58) Field of Classification Search
CPC ..... B60R 7/043; B60R 2011/0012
USPC ..... 224/275, 281, 257, 258, 153, 270, 576, 224/577, 632
See application file for complete search history.

(56) References Cited

U.S. PATENT DOCUMENTS

| | | | | | |
|---|---|---|---|---|---|
| 1,542,163 | A | | 6/1925 | Morde | |
| 2,697,479 | A | * | 12/1954 | Fesler | 297/411.25 |
| 2,767,895 | A | * | 10/1956 | Smith | 224/275 |
| 2,889,051 | A | * | 6/1959 | Kramer | 211/74 |
| 3,090,330 | A | * | 5/1963 | Best | 108/43 |
| 3,386,392 | A | * | 6/1968 | Gramm | 108/44 |
| 3,541,976 | A | * | 11/1970 | Rozas | 108/43 |
| 3,690,446 | A | * | 9/1972 | EShour et al. | 206/525 |
| 3,951,486 | A | * | 4/1976 | Tracy | 312/235.8 |
| 3,986,649 | A | * | 10/1976 | Heimstra | 224/567 |
| 4,915,278 | A | | 4/1990 | Smith | |
| 5,046,433 | A | * | 9/1991 | Kramer et al. | 108/44 |
| 5,269,229 | A | * | 12/1993 | Akapatangkul | 108/44 |
| 5,294,026 | A | * | 3/1994 | McGirt | 224/549 |
| 5,370,060 | A | * | 12/1994 | Wang | 108/44 |
| 5,511,493 | A | * | 4/1996 | Kanehl, Jr. | 108/44 |
| 5,551,615 | A | | 9/1996 | McIntosh | |
| 5,678,741 | A | * | 10/1997 | Schieber | 224/275 |
| 5,724,225 | A | * | 3/1998 | Hrusoff et al. | 361/679.55 |
| 5,813,354 | A | * | 9/1998 | Scott | 108/44 |
| 5,887,777 | A | * | 3/1999 | Myles et al. | 224/578 |
| 5,938,096 | A | * | 8/1999 | Sauer et al. | 224/625 |
| 5,971,148 | A | * | 10/1999 | Jackson | 206/320 |
| 5,984,347 | A | * | 11/1999 | Blanc-Rosset | 280/727 |
| 6,381,127 | B1 | | 4/2002 | Maddall et al. | |
| 6,659,319 | B2 | * | 12/2003 | Purpura | 224/576 |
| 6,796,473 | B2 | * | 9/2004 | Purpura | 224/576 |
| 6,830,292 | B1 | * | 12/2004 | Yoda | 297/188.06 |
| 7,048,163 | B2 | * | 5/2006 | Albert et al. | 224/275 |
| 7,301,757 | B2 | * | 11/2007 | Lee et al. | 361/679.27 |
| D558,974 | S | | 1/2008 | Denzer | |
| 7,780,049 | B1 | | 8/2010 | Baranoski | |
| 2004/0200870 | A1 | | 10/2004 | Haber | |
| 2005/0011920 | A1 | * | 1/2005 | Feng | 224/275 |
| 2006/0144884 | A1 | * | 7/2006 | Abbate | 224/585 |
| 2006/0169730 | A1 | * | 8/2006 | Morrison | 224/275 |
| 2007/0045365 | A1 | * | 3/2007 | Guo et al. | 224/275 |
| 2007/0051766 | A1 | | 3/2007 | Spencer | |
| 2007/0222248 | A1 | * | 9/2007 | Maulden et al. | 296/37.15 |
| 2009/0201637 | A1 | | 8/2009 | Daley, III | |
| 2010/0108726 | A1 | * | 5/2010 | Hilgenberg | 224/153 |
| 2010/0116860 | A1 | * | 5/2010 | Tello | 224/576 |
| 2011/0127304 | A1 | * | 6/2011 | Kam | 224/153 |

* cited by examiner

*Primary Examiner* — Justin Larson
*Assistant Examiner* — Lester L Vanterpool
(74) *Attorney, Agent, or Firm* — Kyle A. Fletcher, Esq.

(57) ABSTRACT

The multi-purpose convertible carrier is a briefcase-styled housing inclusive of an adjustable strap, which supports said housing against an end user's torso or a car seat back. The housing opens to form a supporting surface upon which a laptop or tablet computer rests in perpendicular orientation with respect to the torso or car seat back. The adjustable strap extends around an end user's neck or a car seat head rest to support the housing thereon.

16 Claims, 7 Drawing Sheets

MULTI-PURPOSE CONVERTIBLE CARRIER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of convertible equipment carrying devices, more specifically, a carrying device that is convertible and of which supports a laptop computer upon a seat back or about a neck and torso of an individual.

B. Discussion of the Prior Art

As will be discussed immediately below, no prior art discloses a briefcase-styled housing that opens to provide a supporting surface for placement of a laptop or tablet computer thereon; wherein a strap attaches to said housing, and engages around an end user's neck or a headrest of a car seat.

The Spencer Patent Application Publication (U.S. Pub. No. 2007/0051766) discloses a carrier for hands-free support of tablet and notebook computers. However, the carrier does not have a briefcase styled housing that opens to support a laptop or tablet computer thereon, and which can be supported around an end user's neck or a headrest of a car seat.

The Daley, III Patent Application Publication (U.S. Pub. No. 2009/0201637) discloses a carrying bag with a laptop computer support. However, the carrying bag is not a briefcase-styled housing that opens to provide a supporting surface upon which a laptop or tablet computer rest while a strap extends to wrap around a back of a neck or a headrest of a car seat to support the housing there against.

The McIntosh Patent (U.S. Pat. No. 5,551,615) discloses a single strap support neck harness for suspending a scanner or an electronic device. However, the neck harness is not a briefcase-styled housing that opens to support a laptop or tablet computer thereon.

The Denzer et al. Patent (U.S. Pat. No. Des. 558,974) illustrates an ornamental design for a body computer mount, which does not resemble a briefcase that opens to support a tablet computer or laptop thereon.

The Morde Patent (U.S. Pat. No. 1,542,163) discloses an adjustable carrier strap that is worn around a user's neck. However, the adjustable strap does not support a laptop or tablet computer upon a supporting surface emerging from within a housing resembling a briefcase.

The Smith Patent (U.S. Pat. No. 4,915,278) discloses a neck worn support for food or beverage articles. Again, not specifically adapted for the support of a laptop or tablet computer from a housing that resembles a briefcase, and which opens to offer a supporting surface.

The Maddali et al. Patent (U.S. Pat. No. 6,381,127) discloses a support device for a portable computer in which the computer is held against the person's mid section and also supported by a strap worn around their neck. However, the strap engages the shoulder's of the end user, and is not adapted for use with a headrest of a car seat.

The Baranoski Patent (U.S. Pat. No. 7,780,049) discloses a body support for a portable computer. However, the body support is not a briefcase that folds open to provide a supporting surface.

The Hilgenberg Patent Application Publication (U.S. Pub. No. 2010/0108726) discloses a computer back pack that can be positioned on the front mid section of a user. Again, the back pack does not resemble a briefcase that opens to support a laptop or tablet computer, and inclusive of a strap for use about a neck of an end user or a headrest of a car seat.

The Haber Patent Application Publication (U.S. Pub. No. 2004/0200870) discloses a strap assembly for supporting a tray. Again, the assembly is not a briefcase-styled housing that supports a laptop or tablet computer against a torso or car seat back via a single strap.

While the above-described devices fulfill their respective and particular objects and requirements, they do not describe a briefcase-styled housing that opens to provide a supporting surface for placement of a laptop or tablet computer thereon; wherein a strap attaches to said housing, and engages around an end user's neck or a headrest of a car seat. In this regard, the multi-purpose convertible carrier departs from the conventional concepts and designs of the prior art.

SUMMARY OF THE INVENTION

The multi-purpose convertible carrier is a briefcase-styled housing inclusive of an adjustable strap, which supports said housing against an end user's torso or a car seat back. The housing opens to form a supporting surface upon which a laptop or tablet computer rests in perpendicular orientation with respect to the torso or car seat back. The adjustable strap extends around an end user's neck or a car seat head rest to support the housing thereon.

It is an object of the invention to provide a convertible carrier that rests against a torso of an end user or a car seat back in order to support a laptop or tablet computer in perpendicular orientation there with.

A further object of the invention is to provide an adjustable strap that adjusts to accommodate different size and shape considerations associated with torsos and car seat backs.

An even further object of the invention is to provide a briefcase-styled housing that opens along a side, which folds down to form a supporting surface with which to place the laptop or tablet computer.

A further object of the invention is to provide an articulating side that can rotate from a closed state to a perpendicular orientation with the remaining portion of the housing.

A further object of the invention is to provide a briefcase-styled housing that is of hollowed construction, and which opens to provide the supporting surface associated with its use.

Another object of the invention is to provide an adjustable stop, which working on conjunction with the hinge shall enable the side to rotate and form other acute or obtuse angles with respect to the remaining portion of the housing as needed where perpendicular orientation is not ideal.

These together with additional objects, features and advantages of the multi-purpose convertible carrier will be readily apparent to those of ordinary skill in the art upon reading the following detailed description of presently preferred, but nonetheless illustrative, embodiments of the multi-purpose convertible carrier when taken in conjunction with the accompanying drawings.

In this respect, before explaining the current embodiments of the multi-purpose convertible carrier in detail, it is to be understood that the multi-purpose convertible carrier is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the multi-purpose convertible carrier.

It is therefore important that the claims be regarded as including such equivalent construction insofar as they do not depart from the spirit and scope of the multi-purpose convertible carrier. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
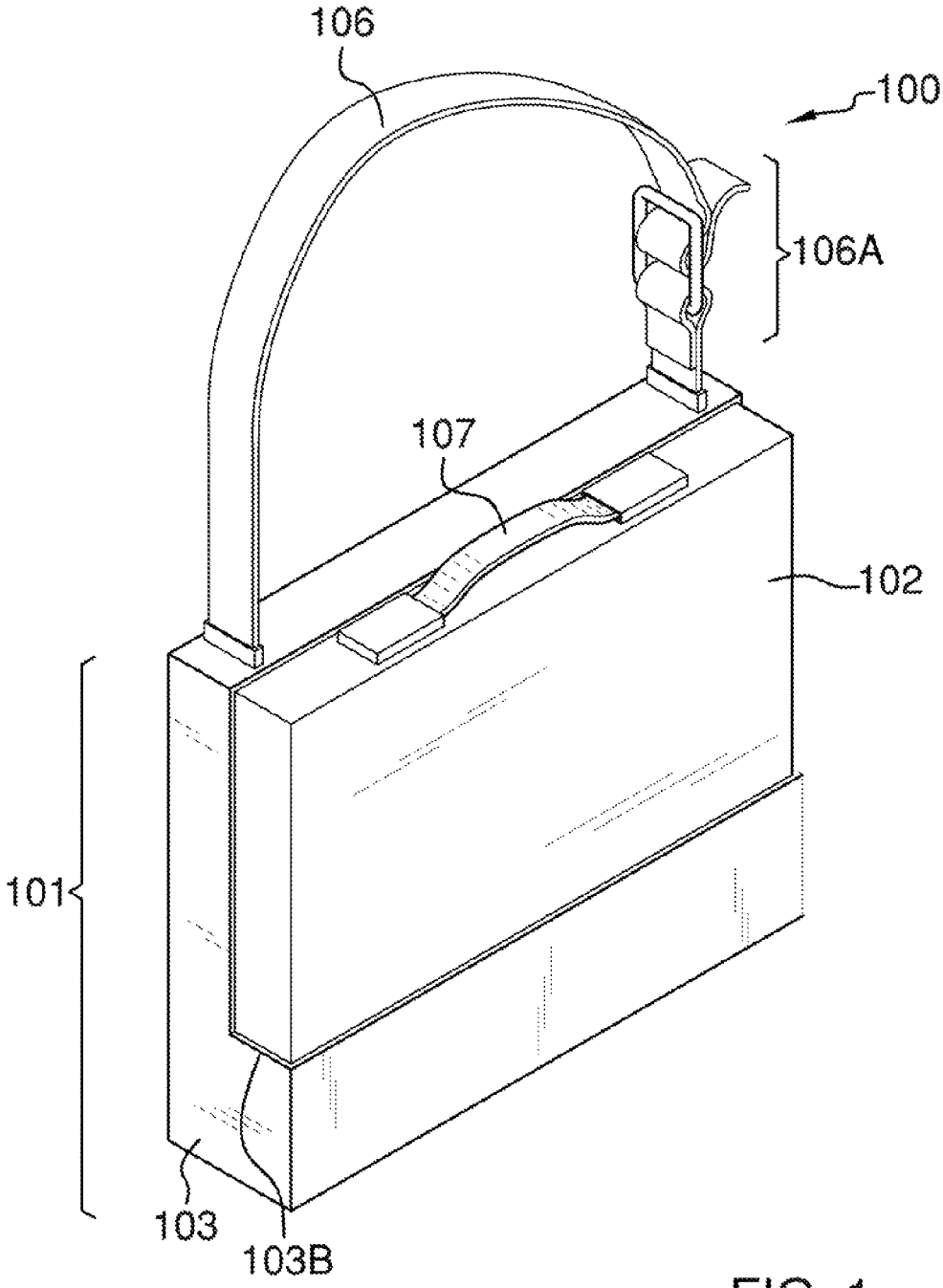
FIG. 1 illustrates a perspective view of the multi-purpose convertible carrier by itself, and in a closed state, and further detailing the handle located on the side capable of rotating to expose the supporting surface as well as detailing the adjustable strap.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. A multi-purpose convertible carrier 100 (hereinafter invention) includes a housing 101 that resembles a briefcase, and which is further defined by a side 102 and a base 103. The side 102 attaches to the base 103 via a hinge 104. The side 102 and the base 103 are both contoured to form a hollowed housing 101 when in a closed state as in FIG. 1. Moreover, the side 102 has a supporting surface 102A, which is exhibited when the side 102 is rotated downwardly with respect to the base 103, and upon which an object 130 may rest.

It shall be hereby asserted that the term 130 is being used to define a laptop computer or tablet computer, or other sized object. Moreover, the invention 100 is designed to support the object 130 at an angle 140 with respect to a torso 150 of an end user 151 or a car seat back 160 of a car seat 161. Moreover, it shall be noted that when the invention 100 is not in use supporting the object 130 against the torso 150 or the car seat back 160, the housing 101 can return to the closed state (see FIG. 1) with the object 130 stored within the housing 101.

Located within the housing 101 is an adjustable stop 105, which engages the side 102. More specifically, the adjustable stop 105 slides up and down an inner surface 103A of the base 103. The adjustable stop 105 slides along a track 105A, which is integrated into the inner surface 103A. Moreover, the adjustable stop 105 includes a spring-loaded button 105B, which when depressed enables the adjustable stop 105 to slide up or down the track 105A, and upon release shall lock the adjustable stop 105 in place with respect to the track 105A.

The side 102 includes boundary walls 102C, which help to form a tray configuration to the supporting surface 102A such that the object 130 cannot slide off of the supporting surface 102A. It shall be further noted that the boundary walls 102C adorn all four edges of the side 102, and including the inner edge 102B. It shall be noted that the inner edge 102B refers to the boundary wall 102C located along the inner side portion of the side 102 (see FIGS. 5B and 5C). The boundary wall 102C located on the inner edge 1028 abuts the adjustable stop 105 with respect to the side 102. It shall be further noted that a handle 107 extends from an outer surface of the boundary wall 102C opposite of the inner edge 102B. The handle 107 provides a means of grabbing the invention 100 when not in use in support of the object 130.

Figure 5A:
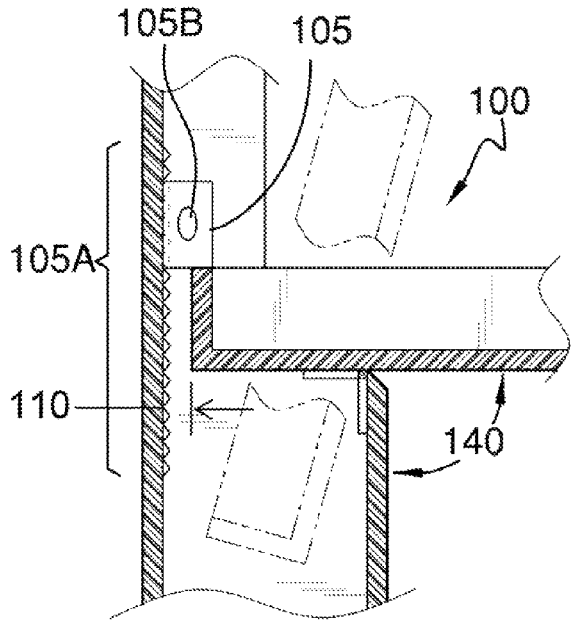
FIG. 5A illustrates a cross-sectional view of the multi-purpose convertible carrier along line 5-5 in FIG. 3, and detailing the hinge and adjustable stop, which enable rotation of the side exhibiting the supporting surface at a perpendicular orientation.
Figure 6:
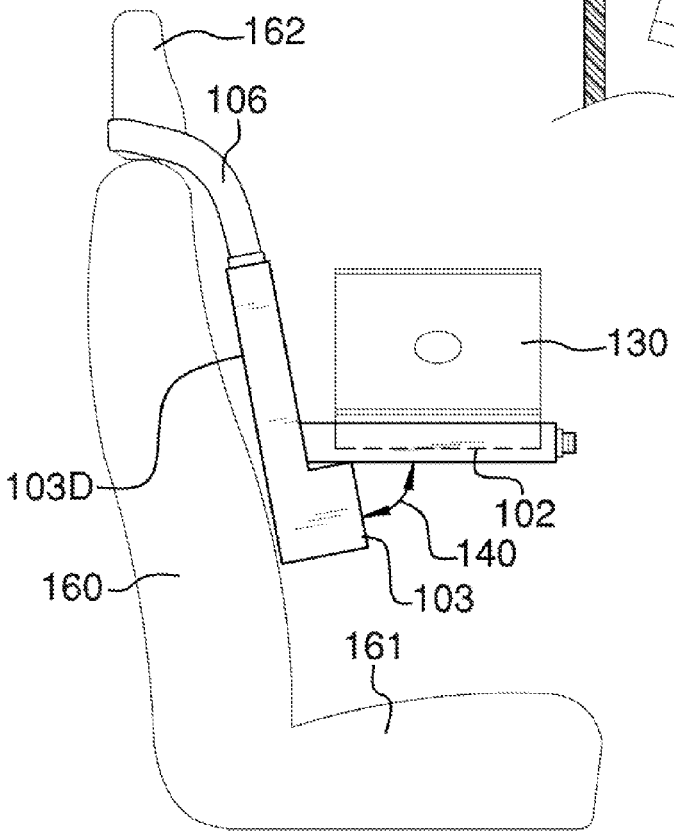
FIG. 6 illustrates a side view of the multi-purpose convertible carrier in use upon a car seat back in which a laptop computer is seated upon the supporting surface.
Figure 5B:
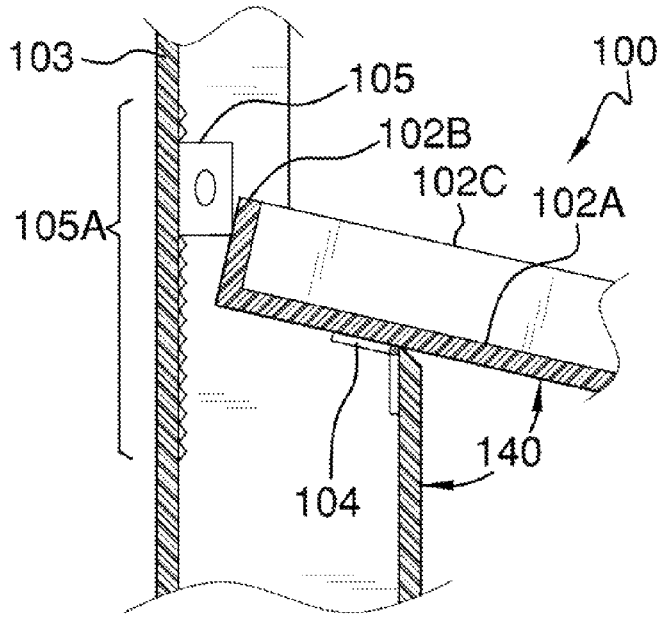
FIG. 5B illustrates a cross-sectional view of the multi-purpose convertible carrier along line 5-5 in FIG. 3, and detailing the rotation of the side exhibiting the supporting surface at an obtuse orientation.
Figure 5C:
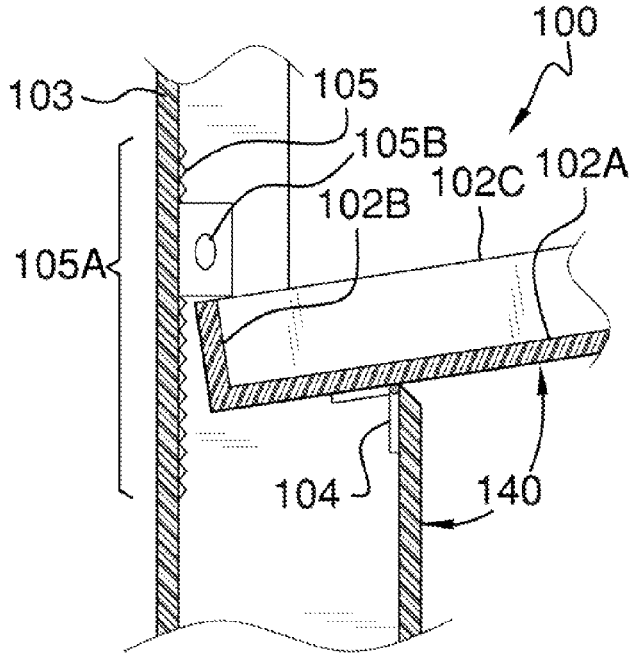
FIG. 5C illustrates a cross-sectional view of the multi-purpose convertible carrier along line 5-5 in FIG. 3, and detailing the rotation of the side exhibiting the supporting surface at an acute orientation.
Figure 7:
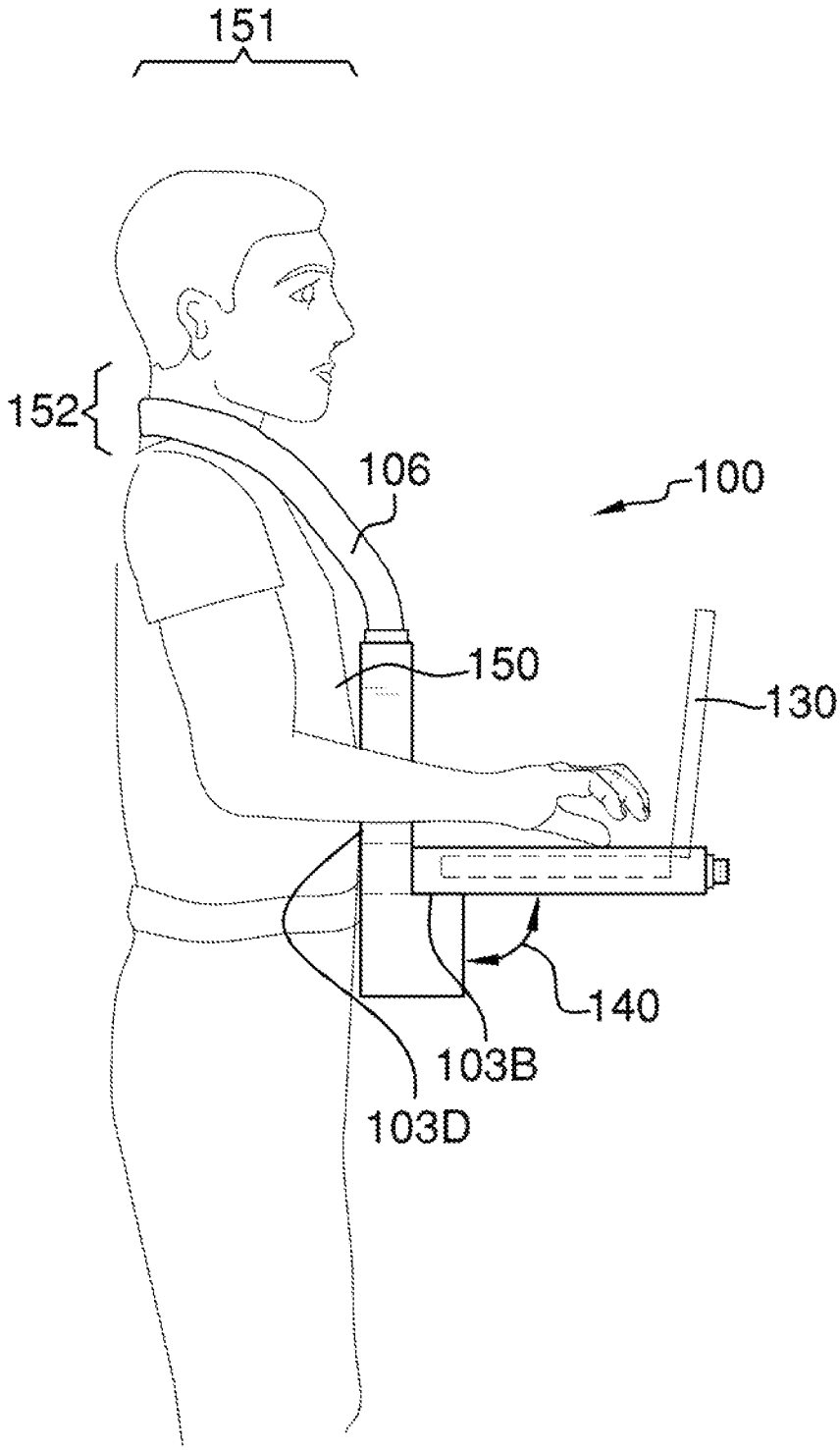
FIG. 7 illustrates a side view of the multi-purpose convertible carrier in abutting use with an end user's torso, and with a laptop resting upon the supporting surface.

In referring to FIG. 5A, it shall be noted that the inner edge 102B of the side 102 has a gap 110 with respect to the base 103. The gap 110 enables the side 102 to freely rotate to form different angles with respect to the base 103 (see FIGS. 5B and 5C).

Located on the housing 101 is an adjustable strap 106. The adjustable strap 106 attaches to and extends from a top surface 102B of the side 102, and from which shall extend around a neck 152 of the end user 151 or to a head rest 162 of the car seat 161. The adjustable strap 106 includes a buckle 106A, which enables the length of the adjustable strap 106 to vary depending upon the conditions of use with the end user 151 or the car seat 161.

The base 103 has a unique shape, which is to say the profile of the base 103 has a step 103B from which the hinge 104 and the side 102 attach and rotate from. That being said, the base 103 has a hollow cavity 103C below where the side 102 interacts with the base 103 to from the housing 101. It shall also be further noted that the base 103 includes a back surface 103D, which rests against the torso 150 and the seat back 160 when in use.

Figure 2:
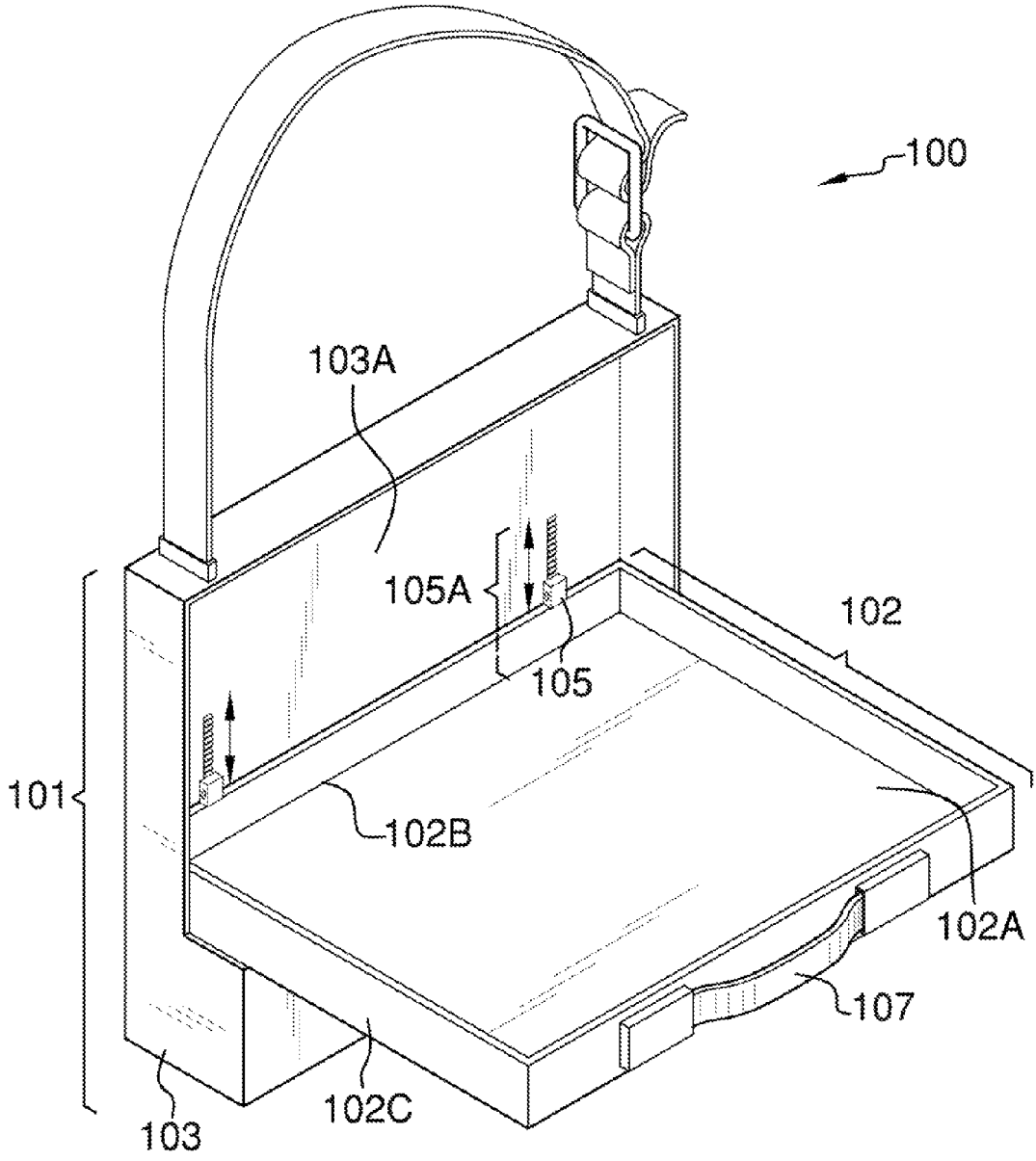
FIG. 2 illustrates a perspective view of the multi-purpose convertible carrier by itself, and in an opened state, and further detailing the side rotated down to a perpendicular orientation with respect to the remaining portion of the housing, and while exhibiting the supporting surface.
Figure 2A:
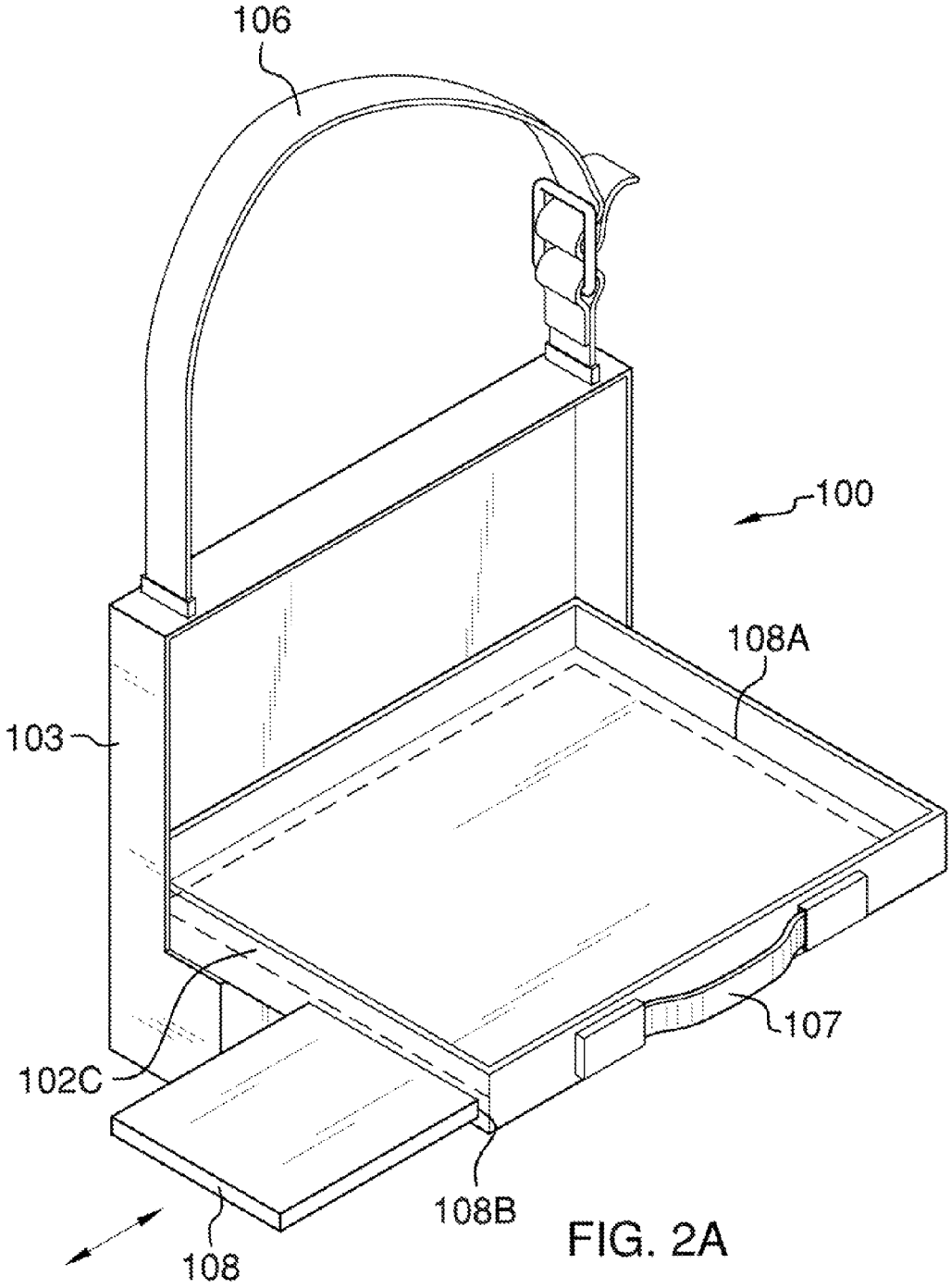
FIG. 2A illustrates a perspective view of the multi-purpose convertible carrier in an opened state in which the side includes a false bottom within which an extendable mouse pad can extend or retract from a left or right side.
Figure 3:
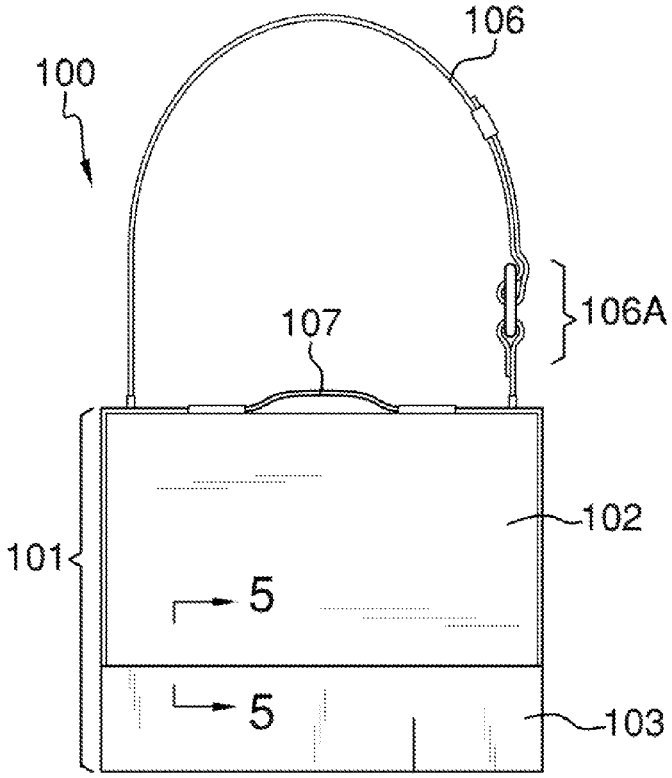
FIG. 3 illustrates a front view of the multi-purpose convertible carrier.
Figure 4:
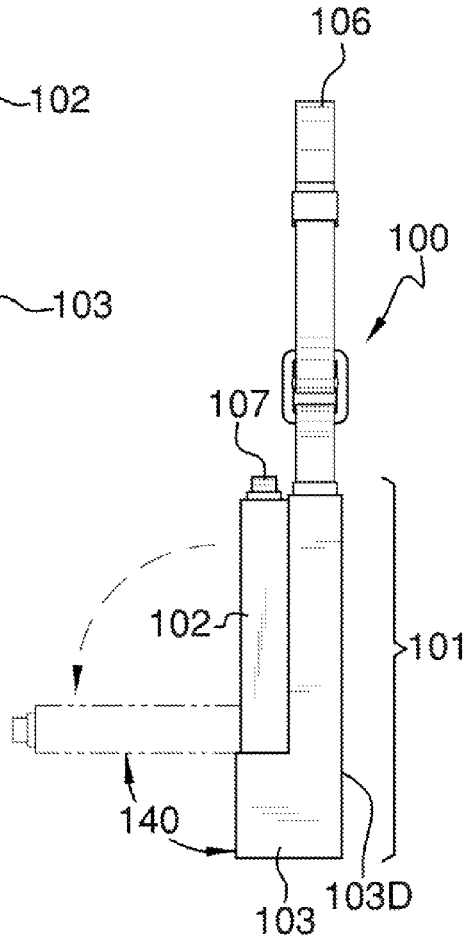
FIG. 4 illustrates a side view of the multi-purpose convertible carrier in which the side is in a closed state with an arrow indicating rotational movement to a perpendicular orientation with respect to the remaining portion of the housing.

Referring to FIG. 2A, the invention 100 may include an extendable mouse pad 108, which extends and retracts from either the left or right side of the housing 101. More specifically, the extendable mouse pad 108 extends or retracts from either the left or right of the side 102. Moreover, the side 102 includes a false bottom 108A, which forms a cavity for placement of the extendable mouse pad 108 there under. The false bottom 108A is the supporting surface 102A describe above, and supports the object 130 thereon. A slot 108B enables the extendable mouse pad 108 to slide in and out of the boundary wall 102C of the side 102.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A multi-purpose convertible carrier comprising:

a housing resembling a briefcase and which includes a base hingedly attached to a side that rotates therefrom to exhibit a supporting surface upon which an object rests;

wherein the base has a back surface that rests against a torso of an end user or a car seat back of a car seat;

wherein an adjustable strap extends from a top surface of the base and adjusts around a neck of said end user or a head rest of said car seat back;

wherein the side includes an inner edge of a boundary wall that engages an adjustable stop provided along an inner surface of the base, and which dictates the angle formed between the base and the side;

wherein the adjustable stop slides along a track that is integrated into the inner surface of the base; wherein the adjustable stop includes a spring-loaded button, which when depressed enables the adjustable stop to slide up or down the track, and upon release shall lock the adjustable stop in place with respect to the track.

2. The multi-purpose convertible carrier as described in claim 1 wherein the side and the base when in a closed state form a hollowed housing within which the object is stored between use.

3. The multi-purpose convertible carrier as described in claim 1 wherein the side rotates down from the closed state to form an angle with respect to the base.

4. The multi-purpose convertible carrier as described in claim 1 wherein the side includes boundary walls on all four sides, which prevent the object from sliding off of the supporting surface when in use.

5. The multi-purpose convertible carrier as described in claim 4 wherein the boundary walls adorn the four edges of the side.

6. The multi-purpose convertible carrier as described in claim 5 wherein a handle extends from an outer surface of the boundary wall opposite of the inner edge.

7. The multi-purpose convertible carrier as described in claim 1 wherein the adjustable strap includes a buckle, which enables the length of the adjustable strap to vary.

8. The multi-purpose convertible carrier as described in claim 4 wherein the side includes a false bottom from which an extendable mouse pad extends and retracts from either the left or right side of the housing.

9. The multi-purpose convertible carrier as described in claim 8 wherein the extendable mouse pad extends or retracts from either the left or right of the side; wherein a slot enables the extendable mouse pad to slide in and out of the boundary wall of the side.

10. A multi-purpose convertible carrier comprising:

a housing resembling a briefcase and which includes a base hingedly attached to a side that rotates therefrom to exhibit a supporting surface upon which an object rests;

wherein the base has a back surface that rests against a torso of an end user or a car seat back of a car seat;

wherein an adjustable strap extends from a top surface of the base and adjusts around a neck of said end user or a head rest of said car seat back;

wherein the side includes boundary walls, which prevent the object from sliding off of the supporting surface when in use;

wherein the side includes an inner edge of a boundary wall that engages an adjustable stop provided along an inner surface of the base, and which dictates the angle formed between the base and the side;

wherein the adjustable stop slides along a track that is integrated into the inner surface of the base; wherein the adjustable stop includes a spring-loaded button, which when depressed enables the adjustable stop to slide up or down the track, and upon release shall lock the adjustable stop in place with respect to the track.

11. The multi-purpose convertible carrier as described in claim 10 wherein the side and the base when in a closed state form a hollowed housing within which the object is stored between use.

12. The multi-purpose convertible carrier as described in claim 10 wherein the side rotates down from the closed state to form an angle with respect to the base.

13. The multi-purpose convertible carrier as described in claim 10 wherein the boundary walls adorn along four edges of the side.

14. The multi-purpose convertible carrier as described in claim 13 wherein a handle extends from an outer surface of the boundary wall opposite of the inner edge.

15. The multi-purpose convertible carrier as described in claim 10 wherein the adjustable strap includes a buckle, which enables the length of the adjustable strap to vary.

16. The multi-purpose convertible carrier as described in claim 10 wherein the side includes a false bottom from which an extendable mouse pad extends and retracts from either the left or right side of the housing.

* * * * *